US008283552B2

(12) United States Patent
van Ekstrom

(10) Patent No.: US 8,283,552 B2
(45) Date of Patent: Oct. 9, 2012

(54) DOCKING SYSTEM FOR PICKUPS ON ELECTRIC GUITARS

(75) Inventor: Gordon van Ekstrom, Kirkland, WA (US)

(73) Assignee: GDK Corporation, Coeur D'Alene, ID (US)

( * ) Notice: Subject to any disclaimer, the term of this patent is extended or adjusted under 35 U.S.C. 154(b) by 0 days.

(21) Appl. No.: 12/952,100

(22) Filed: Nov. 22, 2010

(65) Prior Publication Data

US 2011/0113946 A1 May 19, 2011

Related U.S. Application Data

(63) Continuation of application No. 12/508,493, filed on Jul. 23, 2009, now Pat. No. 7,838,758, which is a continuation-in-part of application No. 11/612,780, filed on Dec. 19, 2006, now abandoned.

(51) Int. Cl.
*G10H 1/32* (2006.01)
*G10H 3/00* (2006.01)

(52) U.S. Cl. ..... 84/743; 84/291

(58) Field of Classification Search ..... 84/290, 84/291, 267, 726, 743
See application file for complete search history.

(56) References Cited

U.S. PATENT DOCUMENTS 4,334,452 A 6/1982 Morrison et al.
4,425,831 A * 1/1984 Lipman ..... 84/743
4,433,603 A * 2/1984 Siminoff ..... 84/726
4,854,210 A 8/1989 Palazzolo
4,872,386 A 10/1989 Betticare
5,029,511 A 7/1991 Rosendahl
5,235,891 A * 8/1993 Klein ..... 84/291
5,252,777 A * 10/1993 Allen ..... 84/726
5,335,576 A 8/1994 Hayashi
5,637,823 A * 6/1997 Dodge ..... 84/743
5,767,432 A 6/1998 Randolph
5,929,362 A 7/1999 Oteyza
6,043,422 A * 3/2000 Chapman ..... 84/723
6,111,184 A * 8/2000 Cloud et al. ..... 84/723
6,253,654 B1 * 7/2001 Mercurio ..... 84/267
6,781,050 B2 8/2004 Olevera et al.
7,256,343 B2 8/2007 Brubaker et al.
(Continued)

FOREIGN PATENT DOCUMENTS

EP 0678852 10/1995
(Continued)

*Primary Examiner* — Jeffrey Donels

(57) ABSTRACT

A module for removable insertion into a stringed instrument body, the body having a transverse cavity extending from a lateral edge. A first fixation device is attached to the body in the cavity and having electrically conductive contact members. The module includes a base configured to engage the cavity as the module travels along an axis of movement into the cavity. The pickup module assembly having a base slidably inserted into the cavity along an axis from the lateral edge between removed and inserted positions. A plurality of pickups are carried by the base in operative proximity to the strings. A second fixation device is attached to the base and positioned to slideably engage the first fixation device when the base is in the inserted position. First and second electrical connectors are electrically coupled to the plurality of pickups and connected to the second fixation device. The first and second electrical connectors are positioned to sequentially engage the first and second contact members when the base is moved toward the inserted position. The first or second electrical connector being a détente that engage the first fixation device and releaseably engage the first fixation device to limit lateral movement of the base away from the inserted position.

20 Claims, 8 Drawing Sheets

U.S. PATENT DOCUMENTS

| | | | | |
|---|---|---|---|---|
| 7,442,865 | B2 | 10/2008 | Moghaddam | |
| 7,453,033 | B2 | 11/2008 | Redard | |
| 7,459,624 | B2 * | 12/2008 | Schmidt et al. | 84/477 R |
| 7,538,269 | B2 | 5/2009 | van Ekstrom | |
| 7,635,809 | B2 | 12/2009 | Higgs et al. | |
| 7,737,349 | B1 * | 6/2010 | Spurgeon et al. | 84/291 |
| 7,838,758 | B2 * | 11/2010 | Van Ekstrom | 84/743 |
| 2003/0164080 | A1 * | 9/2003 | Childress | 84/291 |
| 2008/0105101 | A1 * | 5/2008 | Eldring | 84/291 |
| 2008/0141841 | A1 * | 6/2008 | Van Ekstrom | 84/291 |
| 2008/0141851 | A1 * | 6/2008 | Ekstrom | 84/726 |
| 2009/0082078 | A1 * | 3/2009 | Schmidt et al. | 463/7 |
| 2009/0088250 | A1 * | 4/2009 | Carlson et al. | 463/37 |
| 2009/0183626 | A1 | 7/2009 | Salehi | |
| 2010/0031800 | A1 * | 2/2010 | Ekstrom | 84/291 |

FOREIGN PATENT DOCUMENTS

| | | |
|---|---|---|
| JP | 2004-163717 | 6/2004 |

* cited by examiner

DOCKING SYSTEM FOR PICKUPS ON ELECTRIC GUITARS

CROSS-REFERENCE TO RELATED APPLICATIONS

This application is a continuation of U.S. patent application Ser. No. 12/508,493, titled DOCKING SYSTEM FOR PICKUPS ON ELECTRIC GUITARS, filed Jul. 23, 2009 and issued as U.S. Pat. No. 7,838,758, which is a continuation-in-part of an application Ser. No. 11/612,780 of the same title filed with the United States Patent and Trademark Office on Dec. 19, 2006, all of which are incorporated herein by reference thereto. This application hereby claims priority to the above-referenced patent applications.

TECHNICAL FIELD

This invention relates generally to musical instruments and, more specifically, to electric guitars.

BACKGROUND

Adolph Rickenbacker invented the electric guitar. The popularity of the electric guitar began with the big band era as amplified instruments became necessary to compete with the loud volumes of the large brass sections common to jazz orchestras of the thirties and forties. Initially, electric guitars consisted primarily of hollow archtop acoustic guitar bodies to which electromagnetic transducers known as pickups had been attached.

Electric guitars, in contrast to acoustic guitars, rely upon movement of strings in operative proximity to a pickup to convert the oscillations of a string into electrical impulses for subsequent conversion into sound. Some hybrid electric-acoustic guitars are also equipped with additional microphones or piezoelectric pickups (transducers) that sense mechanical vibration from the body. The guitar's magnetic pickups are embedded or "potted" in epoxy or wax to prevent the pickup from having a microphonic effect.

In 1950, electronics and instrument amplifier maker Clarence Leonidas Fender, better known as Leo Fender, designed the first commercially successful solid-body electric guitar with a single magnetic pickup, which was initially named the "Esquire™". A deluxe version of the Esquire™ included two single-coil, 6-pole pickups (bridge and neck positions) with tone and volume controls, a pickup selector switch; an output jack mounted on the side of the body. A black bakelite pickguard concealed a number of body routings for pickups and the connecting wiring. This deluxe version of the Esquire™ was initially called the "Broadcaster™" but because Gretsch® had a drumset marketed with a similar name (Broadkaster™), Fender® changed the name to "Telecaster®" In 1954, Fender® introduced the Fender® Stratocaster®, or "Strat" as a further deluxe model having an integrated vibrato mechanism, three single-coil pickups, and body comfort contours. A five-way switch allowed the selective activation of combinations of the three pickups to selectably alter the resulting sound.

By 1957, Gibson®, a rival manufacturer had made a major change to its deluxe electric guitar, the "Les Paur" Gibson® included a novel pickup known as the "Humbucker®" The Humbucker®, invented by Seth Lover, is a dual-coil pickup whose two windings are connected out of phase and reverse-wound. The dual coils tend to cancel a 60-cycle induced signal emanating from appliances using 60-cycle power. A Humbucker® also produces a distinctive, more "mellow" tone which appeals to many guitarists. The same effect can be achieved on guitars, such as the Fender® Stratocaster®, when two single-coil pickups are selected to be active at the same time to cancel the hum. As is evident in this discussion, progress of the electric guitar has been marked by the progress in selection and configuration of the several pickups used to generate the characteristic signal.

Pickups exploit induced currents in windings to create the signal. Within a pickup, a magnet is located under each steel string. When a string oscillates at a certain frequency in the presence of the magnet, a magnetic field between the string and magnet oscillates. An electromagnetic coil of wire is wrapped around each magnet such that the oscillating magnetic field induces an alternating current at the same frequency within the coil. Selections of materials, such as numbers of windings in the coil, composition of permanent magnets, and dimensions of the several components, give distinct tonal qualities to various models of pickup.

More recently, many semi-acoustic and acoustic guitars, and some electric guitars and basses, have been fitted with piezoelectric pickups instead of, or in addition to, magnetic pickups. The piezoelectric pickup gives a very wide frequency range output compared to the magnetic pickups and can give large amplitude signals from the strings. The piezoelectric pickup has a very different sound, which some guitarists prefer, and do not receive the 60-cycle hum that affects magnetic pickups.

A guitarist will often select from among various pickups, a set of pickups which match the tone the guitarist desires to produce when performing a musical selection. Removal and replacement of pickups is a generally technical process including removing the strings, detaching each pickup from the guitar body, and disconnecting and connecting the pickups from internal electronics within the guitar body. Given the elaborate process necessary for replacement of the pickups, a guitarist's ability to meaningfully compare the relative tonal qualities of distinct sets of pickups is not possible.

Several inventors have taught mechanisms configured to allow ready removal and replacement of pickups in dockable modules. U.S. Pat. No. 4,425,831 to Lipman, U.S. Pat. No. 5,029,511 to Rosendahl, U.S. Pat. No. 5,252,777 to Allen, U.S. Pat. No. 4,872,386 to Betticare, U.S. Pat. No. 6,253,654 to Mercurio, U.S. Pat. No. 5,563,823 to Dodge, and U.S. Pat. No. 4,854,210 to Palazzolo each teaches modules that are removed by movement perpendicular to a plane the strings define. For instance, Mercurio teaches a rectangular shaped, through-the-body cutout between the neck and bridge to allow the insertion of a module from behind the instrument, drawing the module toward the plane of the strings. Mercurio teaches removal achieved by withdrawing the module away from the string plane through a through-the-body cutout.

Where movement perpendicular to the plane the strings define is required, only two routes are available, into or out of the guitar body. Movement out of the guitar body as taught by Betticare, Rosendahl, Allen, Lipman, and Palazzolo requires the removal and replacement of the strings along with the necessary retuning of the strings before the guitar can be played. Movement into and through the guitar body as Dodge and Mercurio teach, require the guitarist to remove the guitar from the playing posture as a prerequisite to changing the pickup. In either regard, the guitarist is hampered in comparison because of the transient nature of human recollection of sound. The longer the interval between use of one set of pickups and use of a second set of pickups, the less complete the guitarist's recollection, thereby impairing the ability to select the appropriate pickups.

What is missing in the art is an integral module that is readily removable and replaceable to facilitate the comparison of different pickups.

SUMMARY

A module for removable insertion into a body of an instrument having longitudinal strings defines a transverse cavity extending from a lateral edge. The module includes a base configured to engage the cavity. At least one pickup is secured to the base such that upon insertion into the cavity the pickup is in operative proximity to the strings. The pickup has a first and second electrode. A first electrical contact is in first electrical connection to first electrode. A second electrical contact is in second electrical connection to the second electrode.

The present invention comprises a system for insertion and removal of a pickup module that includes a base upon which at least one pickup resides. An electric guitar body is configured to receive the pickup module in a cavity by movement of the pickup module relative to the guitar in a plane parallel to and spaced apart from a plane defined by strings mounted on the electric guitar. The movement is generally perpendicular to the strings. Advantageously, movement of the module into and out of the guitar can occur without loosening or removing the strings. The strings retain their tuned frequencies as a second module is substituted for a first module according to the invention.

In accordance with further aspects of the invention, a seller of pickups can configure a first and a second module with selected pickups to facilitate a guitarist's selection from among a number of pickups at a time of purchase. In an environment where cavities are standardized as among various guitar manufacturers, a guitarist may take his guitar, regardless of manufacturer to the seller's business to browse among the pickups mounted on the various modules.

In accordance with yet another aspect of the invention, the supporting electronics such as a modulation group including a tone control, a volume control, and a multi-way switch may be mounted on the module to allow for distinct modulation controls according to the type of pickup used. By way of non-limiting example, where a magnetic pickup is used the modulation controls may include the tone control, the volume control, and the multi-way switch. Where a piezoelectric pickup is mounted on a module, an additional preamplifier may be included to power the pickup.

In accordance with one embodiment a pickup module assembly is provided for removable insertion into a body of an instrument having longitudinal strings. The body have a transverse cavity extending from a lateral edge. A first fixation device is attached to the body and is positioned in the cavity. The first fixation device has electrically conductive first and second contact members. An electrical jack is connected to the body and electrically connected to the contact members of the first fixation device. The pickup module assembly comprises a base configured for slidable insertion into the transverse cavity along an axis from the lateral edge between removed and inserted positions. A plurality of pickups carried by the base in an arrangement such that upon insertion into the cavity each of the plurality of pickups is in operative proximity to the strings. A second fixation device is attached to the base and positioned to slideably engage the first fixation device when the base is slideably inserted into the cavity to the inserted position. The second fixation device is configured to securely nest with the first fixation device. First and second electrical connectors are electrically coupled to the plurality of pickups and connected to the second fixation device. The first electrical connector is positioned to engage the first contact member of the first fixation device when the base is moved to the inserted position. The second electrical connector is positioned to engage the second contact member of the first fixation device when the base is moved to the inserted position. The first and second electrical connectors are positioned to sequentially engage the first and second contact members when the base is moved toward the inserted position. At least one of the first and second electrical connectors is a détente that engages the first fixation device and releaseably engages the first fixation device to limit lateral movement of the base away from the inserted position. A plurality of modulating electronics are coupled to the base and electrically connected to the first and second electrical connectors.

In another embodiment, a pickup module assembly is provided for removable insertion into a body of an instrument having longitudinal strings. The body defines a cavity extending from a lateral edge. A first fixation device is attached to the body in the cavity, and the body has electrically conductive first and second contact members. The pickup module assembly comprises a base slideably insertable into the cavity under the strings from the lateral edge and being moveable between removed and inserted positions. A pickup is carried by the base and is positioned under the strings when the base is in the inserted position. A second fixation device is attached to the base and positioned to slideably engage the first fixation device when the base is moved from the lateral edge from the removed position to the inserted position. The second fixation device is configured for securely nesting with the first fixation device. First and second electrical connectors electrically are coupled to the pickup and connected to the second fixation device. The first electrical connector is positioned to engage the first contact member when the body is moved to the inserted position. The second electrical connector positioned to engage the second contact member when the body is moved to the inserted position. The first and second electrical connectors are positioned to sequentially engage the first and second contact members when the base is moved toward the inserted position.

In another embodiment an electric guitar assembly comprises a neck, and a guitar body coupled to the neck and having a body. The body has a lateral edge and a transverse cavity extending from the lateral edge. Guitar strings extend longitudinally adjacent to the neck and guitar body. A first fixation device is attached to the guitar body and positioned in the cavity. The first fixation device has electrically conductive first and second contact members. A pickup module assembly is removeably attached to the guitar body, wherein the pickup module assembly is laterally moveable into and out of seated engagement with the guitar body. The pickup module assembly has a base configured for slidable insertion into the transverse cavity along an axis from the lateral edge between removed and inserted positions. A plurality of pickups are carried by the base in an arrangement such that upon insertion into the cavity each of the plurality of pickups is in operative proximity to the strings. A second fixation device is attached to the base and slideably engaged with the first fixation device when the base is in the inserted position. The second fixation device securely nests with the first fixation device when the base is in the inserted position. First and second electrical connectors are electrically coupled to the plurality of pickups and connected to the second fixation device. The first electrical connector engages the first contact member of the first fixation device when the base is in the inserted position and out of engagement with the first contact member when the base is in the removed position. The second electrical connector positioned to engage the second contact member of the first fixation device when the base is moved to the inserted position. The first and second electrical connectors are sequentially engage the first and second contact members when the base is moved toward the inserted position. At least one of the first and second electrical connectors is a détente that engages the first fixation device and releaseably engage the first fixation device to limit lateral movement of the base away from the inserted position.

As will be readily appreciated from the foregoing summary, the invention provides a system for rapid, ready docking and undocking of a set of pickups.

BRIEF DESCRIPTION OF THE DRAWINGS

Preferred and alternative embodiments of the present invention are described in detail below with reference to the following drawings.

DETAILED DESCRIPTION

The principal shortcoming of the current art is that pickups are not readily removed and replaced without requiring a guitarist to remove a guitar from a playing position. The present invention does allow removal and replacement by allowing a pickup module to be removed in a direction generally perpendicular to the primary axis of the guitar as a set of strings define that axis. The module slides in a plane parallel and behind a plane the set of strings define. For purposes of this application the term "lateral movement" shall mean movement that is in a plane parallel to but spaced apart from the plane the strings define and is further along a line generally perpendicular to principal axis of guitar, itself parallel to any one of the strings.

Figure 1:
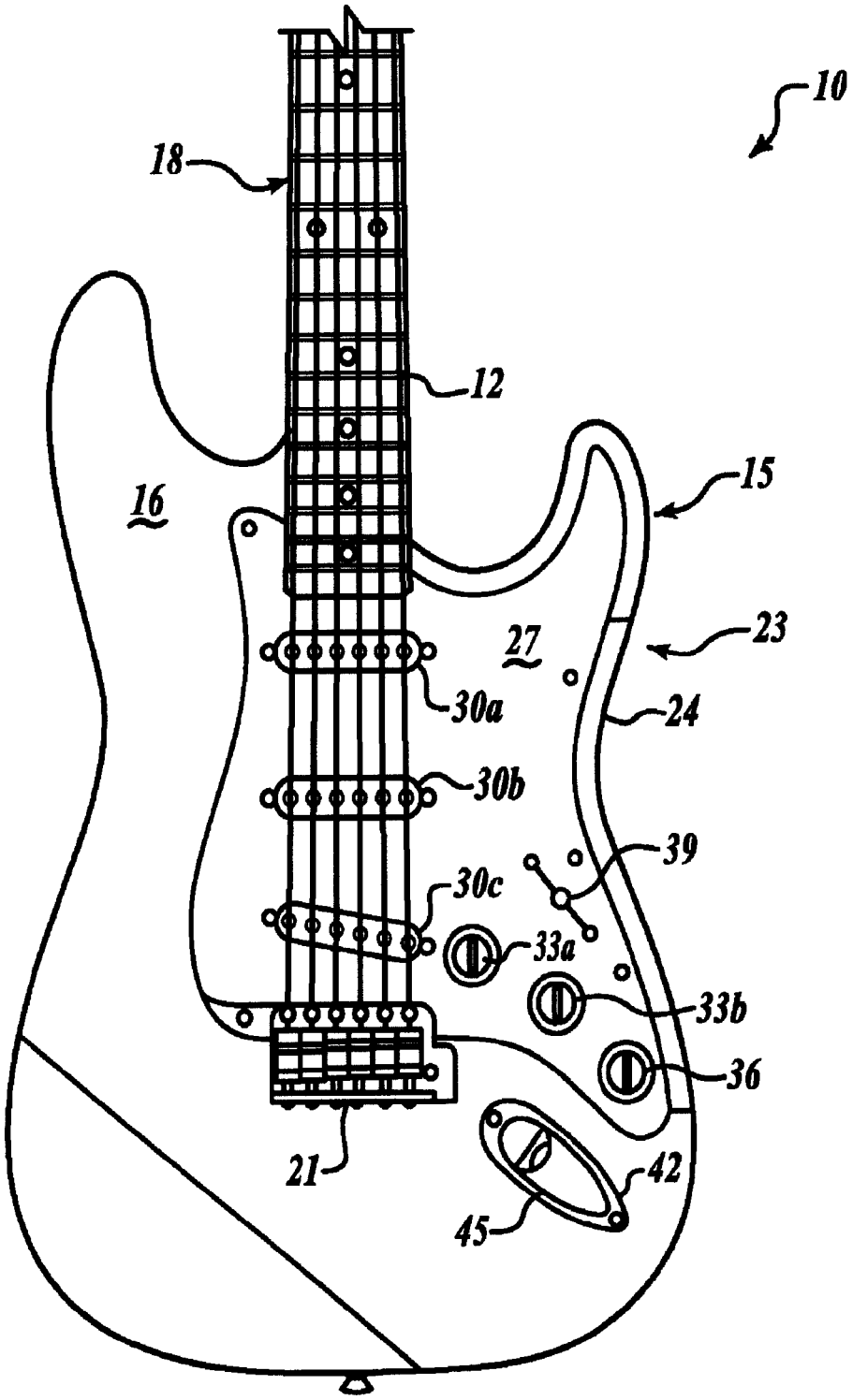
FIG. 1 is a front view of a guitar assembly.

Referring to FIG. 1, a Fender® Stratocaster® is set forth as a non-limiting example of the art. A "Les Paul®" Gibson® or any of a variety of other electric string instruments including electric basses could be suitably altered to conform to the claimed limitations. Thus, a guitar assembly 10 is familiar to the guitarist and includes a neck 12 drawing a set of strings 18 across a face of a body assembly 15 from a bridge 21 mounted fixedly to a body 16. On the body 16, a pickguard 27 extends between the body 16 and the strings 18 and there supports a first pickup 30*a*, a second pickup 30*b*, and a third pickup 30*c* in operative proximity to the strings 18. Also familiar to the guitarist experienced with the (non-limiting exemplary) Fender™ Stratocaster™ is the placement of a first tone control 33*a* and a second tone control 33*b* along with a volume control 36 and a five-way switch 39.

Unlike the standard Fender® Stratocaster®, however, is the placement of a pickup module 23, which, rather than the body 16, supports the pickguard 27 in fixed attachment to a base 24. The base 24 lends structural support to the pickguard 27 creating the rigid module 23 which, in this non-limiting embodiment, also includes the pickups 30*a*, 30*b*, 30*c* and the modulating electronics such as the tone controls 33*a*, 33*b*, the volume control 36, and the five-way switch 39 as well as connecting wiring (not shown). The base 24, in sliding engagement with the body 16, facilitates the easy removal of the pickups 30*a*, 30*b*, 30*c* (and in this non-limiting embodiment the modulating electronics as well). When fully inserted into the body 16, the module 23 is in electrical contact with an electrical jack 45 that allows connection in electrical continuity with an amplifier (not shown).

Figure 2:
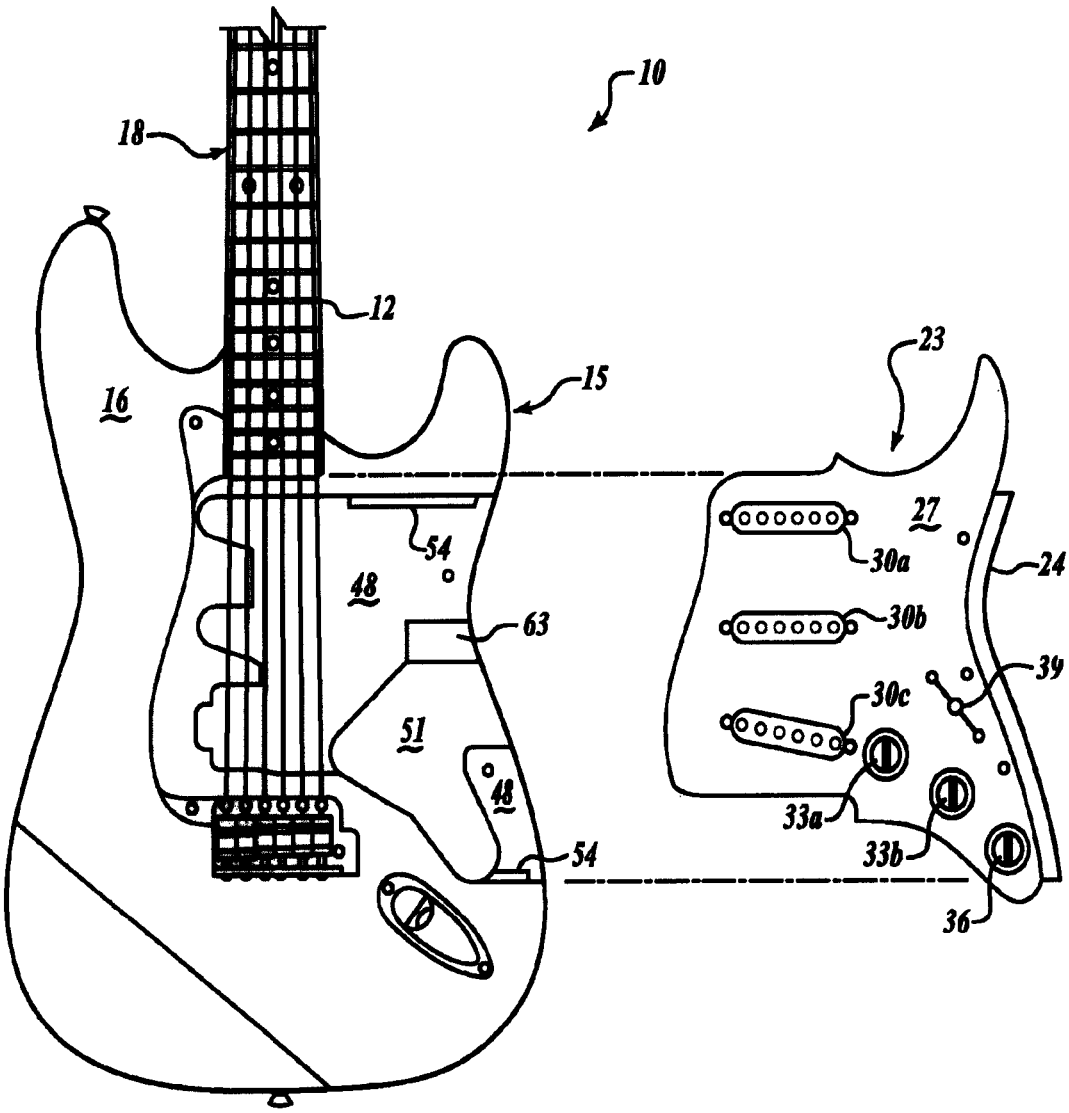
FIG. 2 is an exploded front view of the guitar assembly showing a pickup module.

Reference to FIG. 2, an exploded view of the exemplary guitar assembly 10 is shown gives greater insight into the workings of the embodiment. The sliding module 23 is shown with its base 24 fixed to the pickguard 27 and together supporting the pickups 30*a*, 30*b*, 30*c* and the modulating electronics such as the tone controls 33*a*, 33*b*, the volume control 36, and the five-way switch 39 as well as connecting wiring. Removal of the module 23 from the body assembly 15 reveals both of a shelf 48 and a cavity 51 that the body 16 defines. Configured to suitably envelope reverse ends of the tone controls 33*a*, 33*b*, the volume control 36, and the five-way switch 39 as well as connecting wiring (not shown), the cavity 51 extends laterally to an edge of the body 16 thereby allowing lateral movement of the module 23 without interference. The shelf 48, on the other hand, is advantageously conformed to the base 24 to suitably support the pickguard 27 and, in turn, the base 24 and pickups 30*a*, 30*b*, 30*c* in rigid relationship to the strings 18, thereby preventing variable response based upon a changing distance between the pickups 30*a*, 30*b*, 30*c* and the strings 18 in use.

A pair of rail-like tongues 54 extend from the body 16 to slidingly engage grooves 55 (FIG. 4) defined in the base 24 to allow lateral movement of the module 23 relative to the body 16. In one, non-limiting embodiment, at least one electrical contact plate 63 is provided to allow the pickups 30*a*, 30*b*, 30*c* to complete a circuit with an amplifier (not shown). Advantageously, the contacts plate 63 is oriented in a plane generally parallel to and spaced apart from the plane the strings 18 define. Being so oriented, the contact plate 63 allows brushing contact with at least one electrical contact (not shown) on the base 24 such that when fully inserted into the body 16, the module 23 has electrical continuity through the jack 45 (FIG. 1) with the amplifier (not shown).

Figure 3:
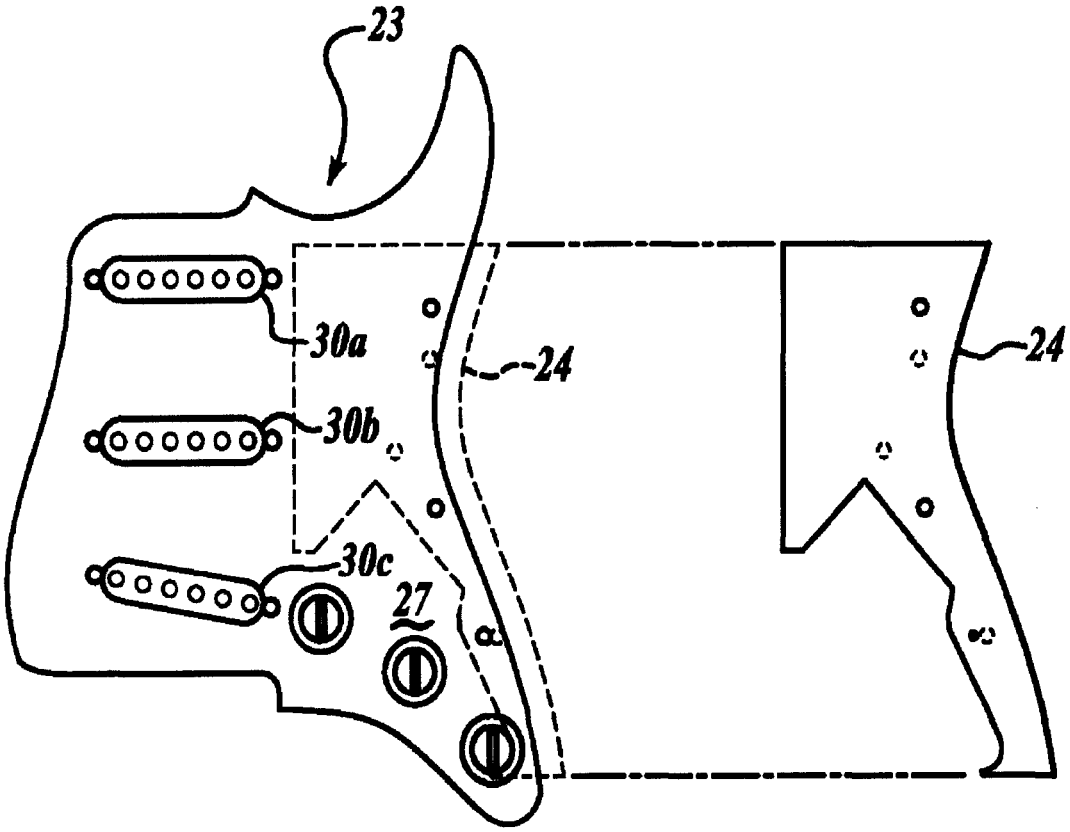
FIG. 3 is an exploded front view of the pickup module showing the base.

The fixed structural relationship between the base 24 and the pickguard 27 that make up the module 23 is observed in an exploded view of the module 23 in FIG. 3. The base 24 is configured, not only to conform to the body 16 (FIGS. 1, 2) but also a perimeter of the shelf 48 (FIG. 2) against which the base 24 rests when the module 23 is fully inserted into the body 16. For this reason, the base 24, when viewed without the pickguard 27 in place is generally elongate and irregular in shape. Shown in phantom relative to the pickguard 27, the base 24 extends to the pickups 30*a*, 30*b*, 30*c*, though the pickups 30*a*, 30*b*, 30*c* are mounted in opposed relationship to the base 24 relative to the pickguard 27.

Figure 4:
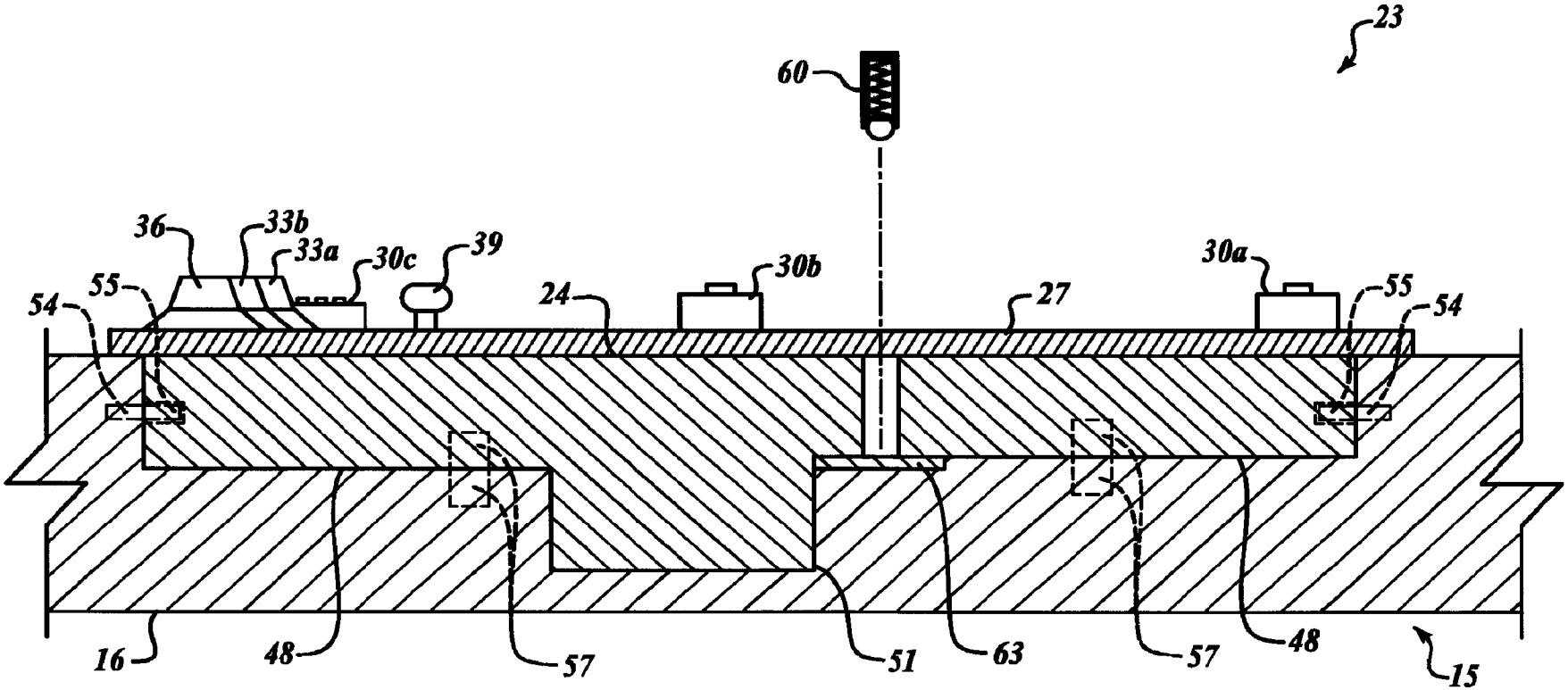
FIG. 4 is a side view of the pickup module.

A side view of the module 23, referring to FIG. 4, shows the base 24 attached to the pickguard 27 and fully received into the body assembly 15. Rail-like tongues 54 inset into the body 16 slidingly engage grooves 55 the base 24 defines. As the module 23 slides on the grooves 55, pickguard 27, mounted on the base 24, supports the pickups 30*a*, 30*b*, 30*c* holding them at a constant height relative to the strings 18 (FIGS. 1, 2), thereby allowing the pickups 30*a*, 30*b*, 30*c* to pass under the strings 18 (FIGS. 1, 2) during insertion or removal of the module 23. The tongues 54 extending into the groves 55 have been selected as a non-limiting exemplary means of allowing only lateral movement during insertion and removal of the of the module 23 relative to the guitar assembly 15. Other means are possible to effect lateral movement. For instance, slides (in some embodiments having rollers turning on ball bearings), such as those commonly used on drawers would be equally effective, though the simplicity of the tongue and groove solution is illustrative of a solution that satisfies the issues relating to degrees of movement.

In this embodiment, the modulating electronics such as the tone controls 33*a*, 33*b*, the volume control 36, and the five-way switch 39 as well as connecting wiring are mounted on the module 23. Where active pickups are used, the power source may be advantageously mounted off of the module and in within the body 16 allowing the module to be changed without changing power supplies. Nothing in the invention requires the mounting on the module, though given the lateral movement of the module and the placement of the modulating electronics relative to the pickups, the non-limiting example is configured to maintain the normal placement of the modulating electronics as in the stock Fender® Stratocaster® and therefore the modulating electronics are mounted on the module 23.

In an alternate embodiment (not shown), the module extends to the pickups 30*a*, 30*b*, 30*c*, from the opposite lateral side of the body 24, drawing the pickups laterally out of the body 24. The pickups 30*a*, 30*b*, 30*c* on the module 23 are removed upwardly when the guitar assembly 10 is in the playing position. In this alternate embodiment, the modulating electronics remain mounted on the body and electrical connection is established in a similar manner to the preferred embodiment. In the alternate embodiment, the pickguard 27 is split into two sections 27*a*, 27*b* along a line generally parallel to the strings 18. In other regards, the alternate embodiment shares many of the same limitations as the exemplary embodiment.

In the exemplary and alternative embodiments, uses of several hardware enhancements ensure that when the module 23 is fully inserted into the body 24, secure, non-rattling engagement occurs. Because unlike the acoustic guitar, an electric guitar produces tones by virtue of the movement of the strings 18 (FIGS. 1, 2) relative to the pickups, and not by resonance of the body 16, complete structural integrity between the module 23 and the body 16 is not necessary. Rather engagement need only be suitably secure to prevent introduction of unwanted vibratory rattles between the module 23 and the body 16.

To achieve such non-rattling engagement, the module 23 may be drawn down into contact with the base 24, by the presence of suitably mated magnets 57 in each of the body 16 and the base 24. The magnets 57 are suitably oriented to attract one another. Alternatively, a cam lock catch (not shown) may be advantageous in achieving the same non-rattling engagement. In a further alternate embodiment, a turn and lock catch can similarly draw the base 16 into non-rattling engagement with the body 24.

In the non-limiting embodiment, ball plungers 60*a*, 60*b*, and 60*c* serve two purposes. First, the ball plungers 60*a*, 60*b*, and 60*c* serve as a detente, limiting lateral movement of the module 23 relative to the body assembly 15 upon insertion, thereby assuring the guitarist that the module 23 is fully inserted into the body 16 giving tactile feedback to the guitarist with positive engagement. Thus, while performing, the guitarist is assured that the module 23 will not move out of engagement with the body 16.

Second, the at least the ball plungers 60*a*, 60*b*, and 60*c* connect in electrical continuity to the at least one contact plate 63, 78*a*, or 78*b* respectively. In this manner, the pickups 30*a*, 30*b*, 30*c* are selectively connected to the jack 45 (FIG. 1) allowing continuity with the amplifier (not shown). While the ball plunger 60 is employed in a preferred embodiment, other electrical connections may be advantageously used to allow continuity with the jack 45 (FIG. 1) such as electrical brushes similar in nature to those used in D.C. motors, or pin-type contacts aligned so that their principal axis is parallel to the lateral movement of the module upon insertion and removal of the module 23 relative to the body 24.

Figure 5:
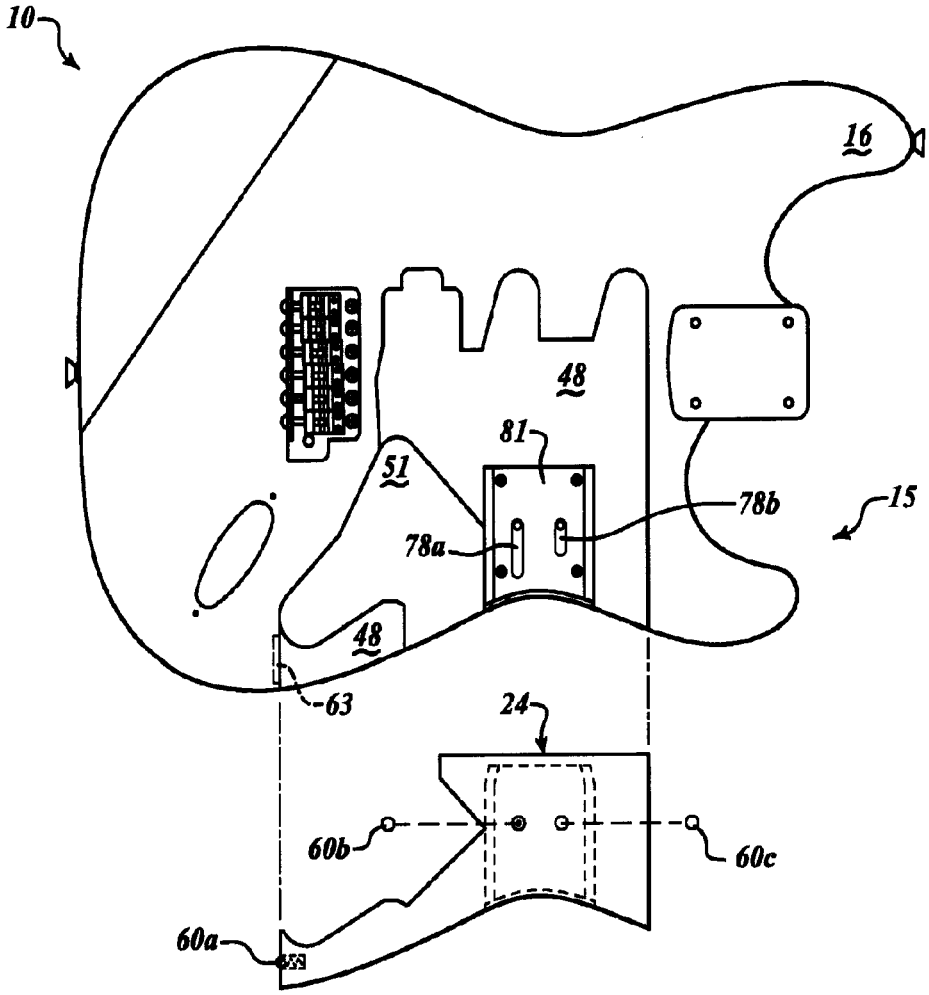
FIG. 5 is an exploded front view of the guitar assembly including an alternate fixation device.
Figure 6:
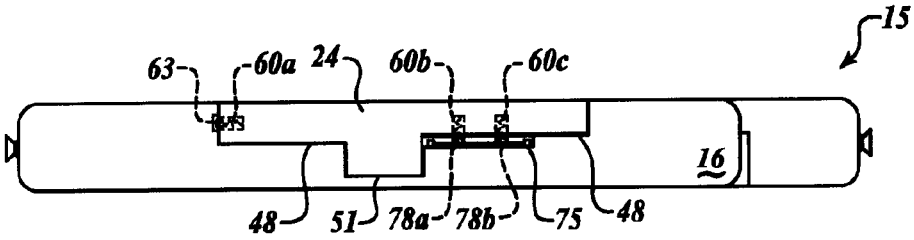
FIG. 6 is a side view of the pickup module nested in the body.

An alternate embodiment is shown in FIG. 5, an exploded front view of the guitar assembly including an alternate fixation device and FIG. 6 a side view of the pickup module nested in the body. Hardware aspects of the embodiment have been disclosed in U.S. Pat. No. 7,538,269 to van Ekstrom dated May 29, 2009 which is entirely incorporated by this reference. Because this embodiment of the invention shares the general geometry of sliding the sliding module 23 (FIG. 2) is shown with reference to its base 24 (the pick guard 27 together with the pickups 30*a*, 30*b*, 30*c* and the modulating electronics such as the tone controls and the volume control 33*a*, 33*b*, 36, and the five-way switch 39 as well as connecting wiring are not shown for purposes of clarity; they being well illustrated in FIG. 2.). In both embodiments, removal of the module 23 from the body assembly 15 reveals both of a shelf 48 and a cavity 51 that the body 16 defines. Visible, affixed to the shelf is a sheath 75 configured to receive the blade 81 which is, in turn, affixed to the module base 24. The sheath 75 and blade 81 cooperate to form a sliding mount. The blade 81 is configured to nest within the sheath 75 thereby obviating the need for the tongue 54 (FIG. 4) and its corresponding groove 55 (FIG. 5) as set forth in an above described embodiment.

As is evident in FIG. 6 the side view of the pickup module showing the alternate fixation device, when in an inserted position, the sheath 75 partially envelops the blade 81 allowing the module 23 (FIG. 2) as shown here by the presence of the base 24 to move in a direction generally perpendicular and offset from the strings (not shown) as in the above described embodiments as the blade 81 moves into and out of nesting engagement with the sheath 75. The module 23 (FIG. 2) along with its base 24 are in operative engagement when the blade 81 is fully inserted into the sheath 75.

For purposes of describing the inventive use at least two ball plungers, and their staggered engagement with at least two contact plates 63, 78*a*, or 78*b* respectively Similarly to the above described embodiment, a first ball plunger 60*a* serves as a detente, limiting lateral movement of the module 23 relative to the body assembly 15 upon insertion, thereby assuring the guitarist that the module 23 is fully inserted into the body 16 giving tactile feedback to the guitarist with positive engagement. Thus, while performing, the guitarist is assured that the module 23 will not move out of engagement with the body 16.

Second, the at least two ball plungers, and their staggered initiation continuity with at least two contact plates 63, 78*a*, or 78*b* respectively assures that amplifiers outside of the body and preamplifiers for the pickups will not experience a power surge. Surges, also known as spikes, are fast, short duration electrical transients in voltage (voltage spikes), current (current spike), or transferred energy (energy spikes) in an electrical circuit. These fast, short duration electrical transients or overvoltages in the electric potential of a circuit are typically caused by closing or opening a switch in a circuit as occurs when the pickups are removed from a circuit including the input of an amplifier. Typically this produces a popping noise from loudspeakers connected to the amplifier. For such sensitive electronics as the high impedance input stage of a quality amplifier, excessive current can flow if this voltage spike exceeds a breakdown voltage at the input, or if it causes avalanche breakdown. In semiconductor junctions, excessive electrical current may destroy or severely weaken that device.

Figure 7A:
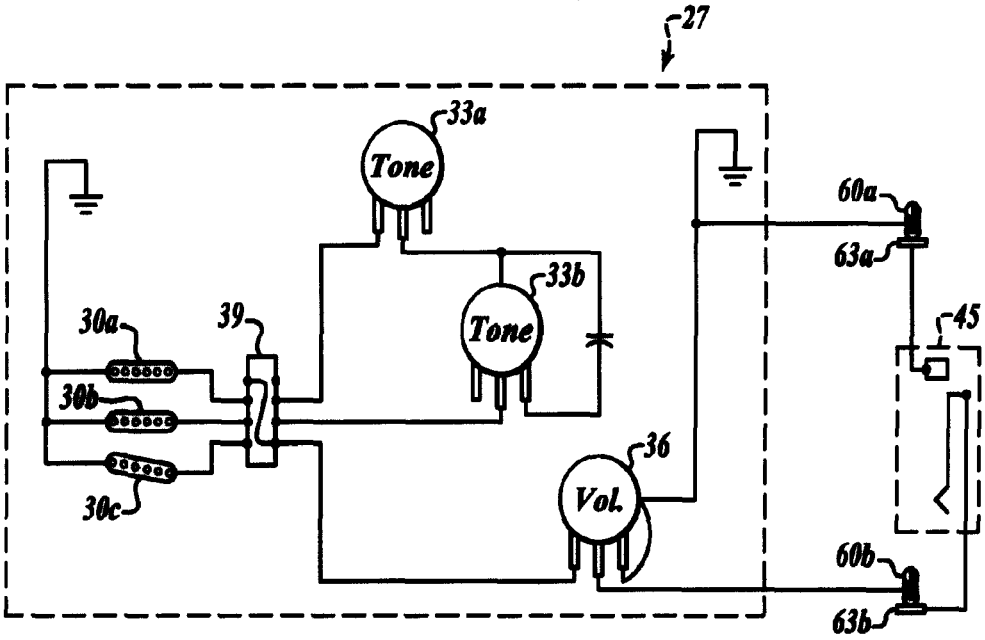
FIGS. 7*a* and 7*b* are schematic circuit diagrams.
Figure 7B:
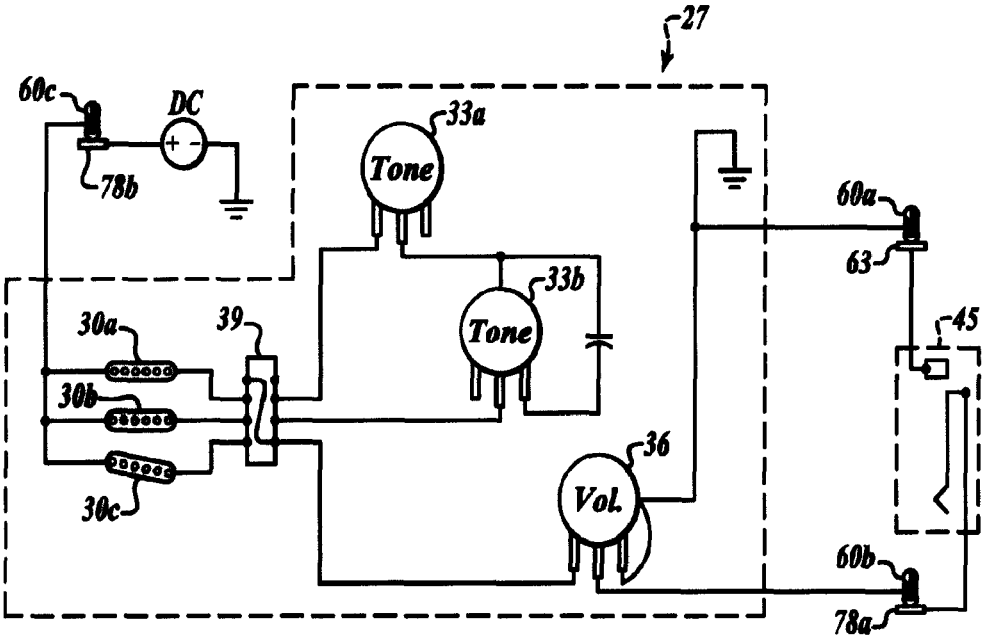

An electrical circuit functions in a closed loop, giving a return path for the current. To complete the circuit passing through the ball plungers 60*a*, 60*b*, and 60*c* and their respective at least two contact plates 63, 78*a*, or 78*b* extending between the pickups 30*a*, 30*b*, and 30*c* (FIG. 1) and the amplifier (not shown), Referring momentarily to FIGS. 7*a* and 7*b*, we see typical circuits that include the inventive configuration of the ball plungers 60*a*, 60*b*, and 60*c* and their respective at least two contact plates 63, 78*a*, or 78*b* in a circuit mounted largely on the pickguard 27 and the shelf 48. In both of the passive embodiment and the active embodiment, the pickups 30*a*, 30*b*, and 30*c* are selectively included in the circuit by operation of the five way switch 30 (or optionally a three-way switch, or no switch at all, the switch not being a necessary part of the inventive configuration).

A passive pickup consists of a magnet and a coil of wire. When the guitar string vibrates in the magnetic field generated by the pickup, an electrical current is generated. This changing magnetic field is all that is needed to create the current. No outside source of power is required, though the current generated is rather small.

Active pickups, in contrast, include a small amplifier (or "pre-amp", since it will be further amplified at a conventional amplifier) that boosts the signal from the pickup. An active pickup generally uses smaller coils of wire making it less susceptible to external noise, yet also offering a "hotter" output due to the pre-amplification stage. Active electronics require power, usually in the form of one or two 9-volt batteries, shown here as DC. The invention is not limited to the shown embodiment but rather is for the explanatory purpose of showing the inclusion of the ball plungers 60*a*, 60*b*, and 60*c* and their respective at least two contact plates 63, 78*a*, or 78*b*, and their advantageous placement upon the module 23. In either of the circuits, the placement of the ball plungers 60*a*, 60*b*, and 60*c* and their respective at least two contact plates 63, 78*a*, or 78*b* is not critical and the spirit of the invention is accomplished by the placement and use of the ball plungers 60*a*, 60*b*, and 60*c* and their respective at least two contact plates 63, 78*a*, or 78*b* and not in the exact placement in the circuit.

Figure 8:
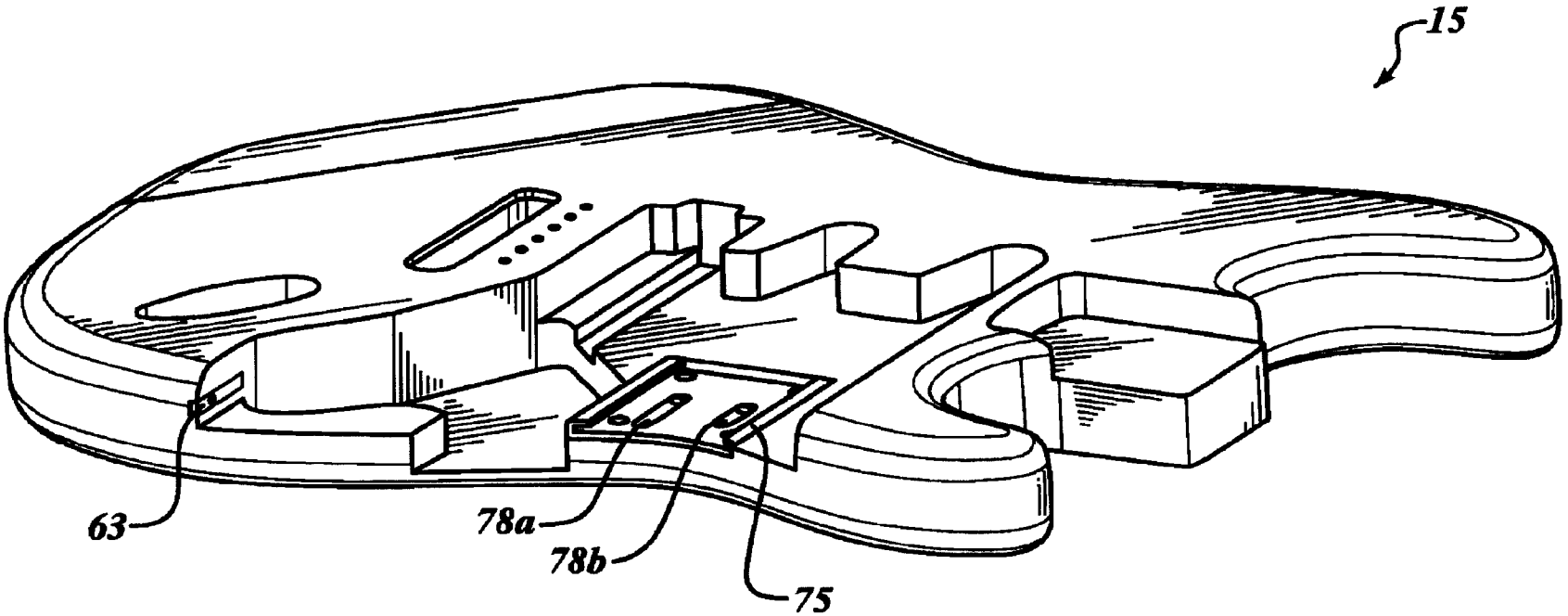
FIG. 8 is an isometric view of a guitar body assembly with contact plates and a sheath.

The placement of the ball plungers 60*a*, 60*b*, and 60*c* and their respective at least two contact plates 63, 78*a*, or 78*b* enables module to selectively engage each of the ball plungers 60*a*, 60*b*, and 60*c* and their respective at least two contact plates 63, 78*a*, or 78*b* in a serial order rather than simultaneously. Additionally, only those ball plungers 60*a*, 60*b*, and 60*c* and their respective at least two contact plates 63, 78*a*, or 78*b* included in the particular circuit, be it active (FIG. 7*b*) or passive (FIG. 7*a*), will be engaged in the circuit. Referring to FIG. 8, the body is shown and within the body the various contact plates 63, and within the sheath 75, contact plates 78*a* and 78*b*. As the module 23 (not shown) slides into and out of the body 15 it is displaced along an axis of movement (here arbitrarily named the x-axis). By selectively displacing the contact places 63, 78*a*, 78*b* in a direction parallel to the axis of movement, the timing of the conductive engagement of the ball plungers 60*a*, 60*b*, and 60*c* and their respective at least two contact plates 63, 78*a*, or 78*b* can be staggered to reduce the likelihood of surges selectively connecting first the ground and then the positive contact plate 78*a* for both the passive and the active pickups and then the power positive contact place 78*b* for the active pickups. In this fashion, a module 23 having active pickups can be exchanged for a module 23 having passive pickups, both without danger of surging voltage and the resulting surge in current and allowing the active circuit to only be energized when suitable for energizing pickups.

Figure 9:
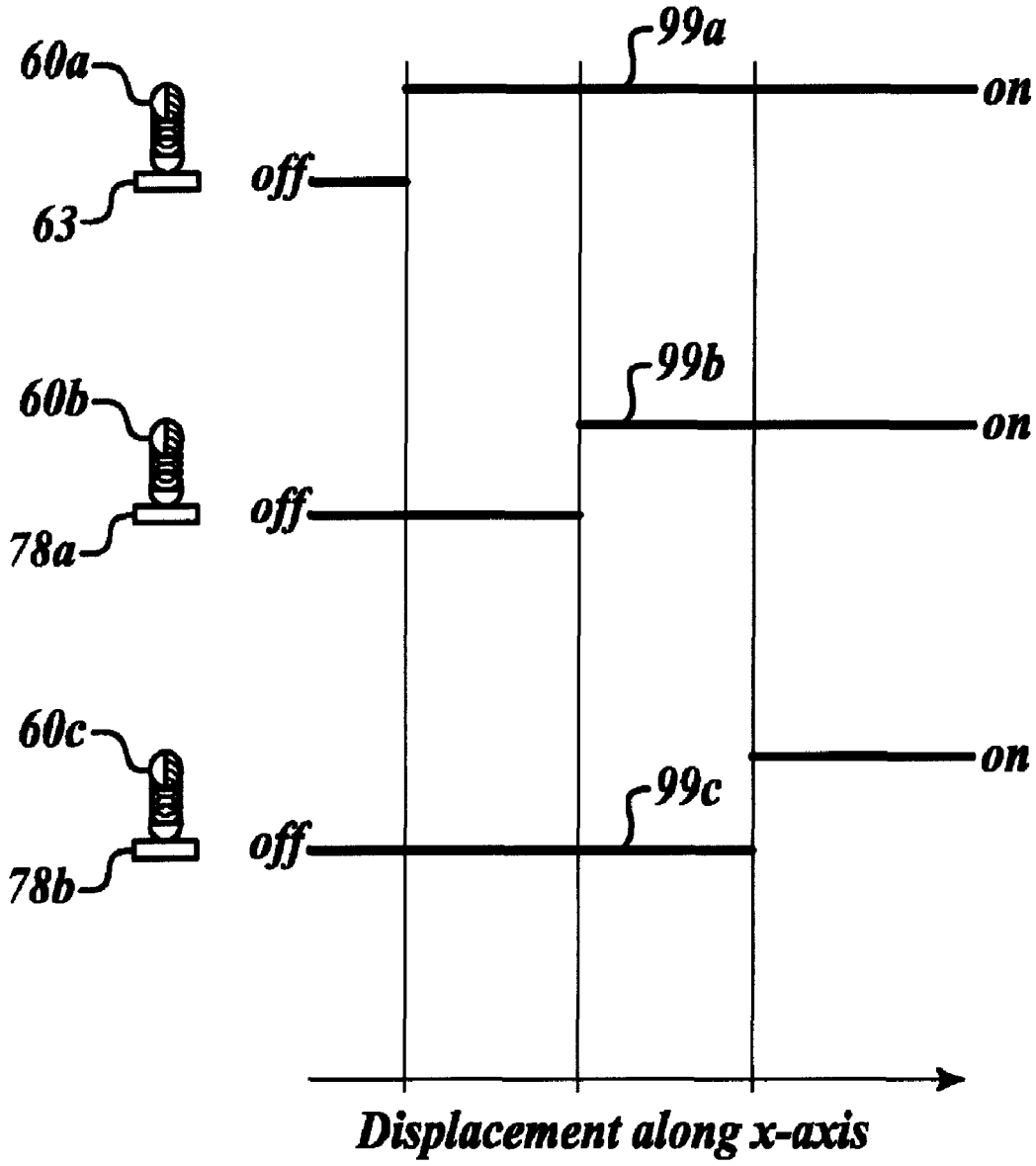
FIG. 9 is a schematic activation waveform.

By way of demonstration, in FIG. 9, an activation waveform is shown for each of the exemplary ball plunger contact plate pair: ball plunger 60*a* and contact plate 63 at waveform 99*a*; ball plunger 60*b* and contact plate 78*a* at waveform 99*b*; and ball plunger 60*c* and contact plate 78*b* at waveform 99*c*. As the module 23 moves along the axis of movement x-axis, the first of the three pairs, ball plunger 60*a* and contact plate 63 makes conductive conduct as shown in waveform's 99*a* transition from low or off to high or on. As the module's 23 movement continues along the axis of movement, the second of the three pairs, ball plunger 60*b* and contact plate 78*a* makes conductive conduct as shown in waveform's 99*b* transition from low or off to high or on. Finally, just as the module 23 slides home, the As the module moves along the axis of movement x-axis, the last of the three pairs, ball plunger 60*c* and contact plate 78*b* makes conductive conduct as shown in waveform's 99*c* transition from low or off to high or on. The last set also serves as the detente earlier described to retain the module in its proper relation to the body 15. The exemplary explanation is not the only order in which conductive engagement occurs. All that is important for the invention is that the contacts are displaced from simultaneous conductive engagement in a direction parallel to the axis of movement, and therefore in time as the module 23 moves into or out of the body 16.

The scope of the invention is not limited by the disclosure of the preferred embodiment. Instead, the invention should be determined by reference to the claims that follow.

I claim:

1. A pickup module assembly for removable insertion into a body of an electric stringed instrument having longitudinal strings, the body defining a transverse cavity extending from a lateral edge, a first fixation device attached to the body and positioned in the cavity, the first fixation device having electrically conductive first and second contact members, and an electrical jack being connected to the body and electrically connected to the contact members of the first fixation device, the pickup module assembly comprising:

a base configured for slidable insertion into the transverse cavity along an axis from the lateral edge between removed and inserted positions;

a plurality of pickups carried by the base in an arrangement such that upon insertion into the cavity each of the plurality of pickups is in operative proximity to the strings;

a second fixation device attached to the base and positioned to slideably engage the first fixation device when the base is slideably inserted into the cavity into the inserted position, the second fixation device configured for securely nesting with the first fixation device;

first and second electrical connectors electrically coupled to the plurality of pickups and connected to the second fixation device, the first electrical connector positioned to engage the first contact member of the first fixation device when the base is moved to the inserted position, and the second electrical connector positioned to engage the second contact member of the first fixation device when the base is moved to the inserted position, the first and second electrical connectors are positioned to sequentially engage the first and second contact members when the base is moved toward the inserted position, at least one of the first and second electrical connectors being a détente that engages the first fixation device and releaseably engages the first fixation device to limit lateral movement of the base away from the inserted position; and a plurality of modulating electronics coupled to the base and electrically connected to the first and second electrical connectors.

2. The assembly of claim 1 wherein the first fixation device is a sheath and the second fixation device is a blade that cooperates with the sheath to form a sliding mount.

3. The assembly of claim 1, further comprising a third electrical connector connected to the plurality of pickups and configured to connect to a power source.

4. The assembly of claim 1 wherein the at least one of the first and second electrical connectors is an electrically conductive ball plunger that is the détente member and that provides electrical continuity between the pickups, the modulating electronics and the instrument.

5. The assembly of claim 4, further comprising a third electrically conductive ball plunger assembly connected to the plurality of pickups and configured to connect to a power source.

6. The assembly of claim 1 wherein the modulating electronics include a tone control, a volume control and a pickup switch.

7. The assembly of claim 1, further comprising an amplifier connected to at least one of the plurality of pickups.

8. The assembly of claim 1, wherein the base further comprises pickguard positionable adjacent to the body.

9. The assembly of claim 1, further comprising the body configured to slideably receiving the base.

10. A pickup module assembly for removable insertion into a body of an instrument having longitudinal strings, the body defining a cavity extending from a lateral edge, a first fixation device attached to the body in the cavity, the body having electrically conductive first and second contact members spaced apart from each other in a first lateral direction, the pickup module assembly comprising:

a base slideably insertable into the cavity under the strings from the lateral edge and being moveable in a second lateral direction between removed and inserted positions, wherein the first lateral direction is different than the second lateral direction;

a pickup carried by the base and positioned under the strings when the base is in the inserted position;

a second fixation device attached to the base and positioned to slideably engage the first fixation device when the base is moved in the second direction from the lateral edge from the removed position to the inserted position, the second fixation device configured for securely nesting with the first fixation device; and first and second electrical connectors electrically coupled to the pickup, the first electrical connector positioned to engage the first contact member when the body is moved to the inserted position, and the second electrical connector positioned to engage the second contact member when the body is moved to the inserted position, the first and second electrical connectors are spaced apart from each other in the first lateral direction and positioned to engage the first and second contact members in sequential order when the base is moved toward the inserted position so the first electrical connector electrically contacts the first contact member before the second electrical connector electrically contacts the second contact member.

11. The assembly of claim 10 wherein at least one of the first and second electrical connectors being a détente that engages at least one of the body and the first fixation device to limit lateral movement of the body away from the inserted position.

12. The assembly of claim 10 wherein the first and second electrical connectors are connected to the second fixation device.

13. The assembly of claim 10, further comprising a third electrical connector connected to the plurality of pickups and configured to connect to a power source.

14. The assembly of claim 10, further comprising an amplifier coupled to at least one of the plurality of pickups.

15. The assembly of claim 10 wherein the base further comprises at least one détente configured to removabley secure the module in engagement within the cavity.

16. An electric stringed instrument assembly, comprising a neck;

a guitar body coupled to the neck and having a body with a lateral edge, a transverse cavity extending from the lateral edge;

guitar strings extending longitudinally adjacent to the neck and guitar body a first fixation device attached to the guitar body and positioned in the cavity, the first fixation device having electrically conductive first and second contact members spaced apart from each other in a first direction, a jack being connected to the guitar body and electrically connected to the first and second contact members of the first fixation device; and a pickup module assembly removeably attached to the guitar body, wherein the pickup module assembly is laterally moveable in a second direction into and out of seated engagement with the guitar body, wherein the second direction is different than the first direction, the pickup module assembly comprising:

a base configured for slidable insertion into the transverse cavity in the second direction along an axis from the lateral edge between removed and inserted positions;

a plurality of pickups carried by the base in an arrangement such that upon insertion into the cavity each of the plurality of pickups is in operative proximity to the strings;

a second fixation device attached to the base and slideably engaged with the first fixation device when the base is in the inserted position, the second fixation device securely nesting with the first fixation device when the base is in the inserted position; and first and second electrical connectors electrically coupled to the plurality of pickups and connected to the second fixation device, the first and second electrical connectors being spaced apart in the first direction, the first electrical connector engaging the first contact member of the first fixation device when the base is in the inserted position and out of engagement with the first contact member when the base is in the removed position, and the second electrical connector positioned to engage the second contact member of the first fixation device when the base is moved to the inserted position, the first and second electrical connectors sequentially engage the first and second contact members when the base is moved toward the inserted position, at least one of the first and second electrical connectors being a détente that engages the first fixation device and releaseably engages the first fixation device to limit lateral movement of the base away from the inserted position.

17. The assembly of claim 16 wherein the pickup module assembly is a first pickup module assembly, and further comprising a second pickup module assembly having a similar construction to the first pickup module assembly and being interchangeable with the first pickup module assembly.

18. The assembly of claim 16 wherein the first fixation device is a sheath and the second fixation device is a blade that cooperates with the sheath to form a sliding mount.

19. The assembly of claim 16 wherein the at least one of the first and second electrical connectors is an electrically conductive ball plunger that is the détente member and that provides electrical continuity between the pickups, the modulating electronics and the instrument.

20. The assembly of claim 1 wherein the base includes a pickguard adjacent to the plurality of pickups.

* * * * *